US011170730B2

(12) United States Patent
Kim et al.

(10) Patent No.: US 11,170,730 B2
(45) Date of Patent: Nov. 9, 2021

(54) DRIVING DEVICE OF FLAT PANEL DISPLAY AND DRIVING METHOD THEREOF

(71) Applicant: Magnachip Semiconductor, Ltd., Cheongju-si (KR)

(72) Inventors: Hyoung Kyu Kim, Cheongju-si (KR); Yeon Kyoung Park, Incheon (KR); Dae Young Yoo, Sejong-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 58 days.

(21) Appl. No.: 16/434,943

(22) Filed: Jun. 7, 2019

(65) Prior Publication Data

US 2020/0035188 A1 Jan. 30, 2020

(30) Foreign Application Priority Data

Jul. 27, 2018 (KR) ..... 10-2018-0088184

(51) Int. Cl.
*G09G 3/36* (2006.01)

(52) U.S. Cl.
CPC ..... *G09G 3/3696* (2013.01); *G09G 3/3685* (2013.01); *G09G 2310/027* (2013.01); *G09G 2310/0291* (2013.01); *G09G 2310/0297* (2013.01); *G09G 2310/08* (2013.01); *G09G 2330/021* (2013.01)

(58) Field of Classification Search
CPC ..... G09G 3/3696; G09G 3/3685; G09G 2310/027; G09G 2310/08; G09G 2330/021; G09G 2310/0297; G09G 2310/0291; G09G 2310/061; G09G 2310/066; G09G 2300/0426; G09G 3/2096; G09G 3/20
See application file for complete search history.

(56) References Cited

U.S. PATENT DOCUMENTS

| | | | | |
|---|---|---|---|---|
| 8,704,814 | B2 | 4/2014 | Yen | |
| 2003/0058234 | A1* | 3/2003 | Kanzaki | G09G 3/3648 345/211 |
| 2012/0032935 | A1* | 2/2012 | Yen | G09G 3/20 345/211 |
| 2016/0098959 | A1* | 4/2016 | Moon | G09G 3/3696 345/205 |
| 2017/0169754 | A1* | 6/2017 | Wang | G09G 3/2018 |
| 2017/0270863 | A1* | 9/2017 | Suh | G09G 3/3688 |
| 2018/0182329 | A1* | 6/2018 | Yu | G09G 3/3685 |

* cited by examiner

*Primary Examiner* — Amit Chatly
(74) *Attorney, Agent, or Firm* — NSIP Law

(57) ABSTRACT

A driving device of a flat panel display configured to receive an image signal and a clock signal includes a driving circuit configured to convert the image signal into pixel data and output the pixel data, a timing controller configured to generate and output a vertical synchronization signal, a horizontal synchronization signal, a source change enable signal, and a display enable signal using the image signal and the clock signal, an output buffer including an input terminal configured to receive the pixel data and an output terminal connected to the flat panel display, and a buffer controller connected to the timing controller and the output buffer and configured to control a bias current, applied to the output buffer, to be decreased by a value during a period.

16 Claims, 5 Drawing Sheets

DRIVING DEVICE OF FLAT PANEL DISPLAY AND DRIVING METHOD THEREOF

CROSS-REFERENCE TO RELATED APPLICATIONS

This application claims the benefit under 35 USC 119(a) of Korean Patent Application No. 10-2018-0088184 filed on Jul. 27, 2018 in the Korean Intellectual Property Office, the entire disclosure of which is incorporated herein by reference for all purposes.

BACKGROUND

1. Field

The following description relates to a driving device of a flat panel display and a driving method of such a flat panel display. The following description also relates to a driving device of a flat panel display and a driving method of such a flat panel display using horizontal and vertical synchronization signals to reduce power consumption.

2. Description of Related Art

Today, various electronic products, for example, laptops, mobile phones, televisions, and other similar devices, have display devices that may allow users to check the device status of such devices and easily get information related to the device status of the devices. A Flat Panel Display (FPD) has advantages such as low power consumption and minimization of device mass, so it is becoming a preferred replacement for a conventional Cathode Ray Tube (CRT) technology for use as a display device.

The FPDs are divided into emitter panel and non-emitter panel device designs, depending on the implementation, in contrast to a projection type of device, in which images projected from a lens are projected onto a screen. For example, the FPDs that directly emit light from a screen are divided into a light emitting type and a non-emitting type depending on whether a light emitting device involving a light emitting material is used. In other words, FPDs are divided based on whether a separate back light is required when using the panel device.

For emitter panels, there are examples such as an organic light emitting display (OLED) panels in which an organic material of a light emitting diode type is used as a light emitting element for a display, and a plasma display panel (PDP) in which a high voltage is applied to plasma to emit light as a display. For non-emitter panels, an example is a typical liquid crystal display (LCD) panel in which a light of a backlight is adjusted to pass through the panel to act as a display.

As described above, the flat panel displays are named according to a shape and material used for a flat panel display, such as an LCD panel, a PDP, an OLED, a field emission display (FED) panel, and so on.

In various types of flat panel displays, a plurality of scan or gate signals and data or source signals are used to display an image. As the size and resolution of the flat panel display increase, the driving load required when the driving device drives the panel increases. Accordingly, the charge/discharge time is relatively shortened. Therefore, in order to satisfy the requirements of a large display panel and to increase the resolution, it is necessary to consider the driving ability of the driving device when designing driving devices for displays.

The driving devices require sufficient driving capability only for a transition period, which is a period during which a pixel capacitor is charged/discharged, of a pixel data signal. When the charging/discharging of the pixel capacitor is completed or when the updating of the pixel data is not required, extra power is wasted in the driving device.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a driving device of a flat panel display is configured to receive an image signal and a clock signal, and includes a driving circuit configured to convert the image signal into pixel data and output the pixel data, a timing controller configured to generate and output a vertical synchronization signal, a horizontal synchronization signal, a source change enable signal, and a display enable signal using the image signal and the clock signal, an output buffer including an input terminal configured to receive the pixel data and an output terminal connected to the flat panel display, and a buffer controller connected to the timing controller and the output buffer and configured to control a bias current, applied to the output buffer, to be decreased by a value during a period.

The period may include a period from a point at which a charging of a pixel capacitor of the flat panel display is completed, based on a current horizontal synchronization signal, up to a point at which a next horizontal synchronization signal occurs.

The period may include a porch period of the vertical synchronization signal.

The buffer controller may be configured to perform controlling during a period set considering a time taken for the bias current to change, a start point of the set period may be selected within a front porch period of the vertical synchronization signal, and an end point of the set period may be selected within a back porch period of the vertical synchronization signal.

The period may include a period from a point at which a charging of a pixel capacitor of the flat panel display is completed, based on a current horizontal synchronization signal, up to a next horizontal synchronization signal, and a porch period of the vertical synchronization signal, wherein during the period of up to the next horizontal synchronization signal, the buffer controller may be configured to control a decreased bias current to return to an original value, by a margin earlier in time than the next horizontal synchronization signal, and wherein during the porch period of the vertical synchronization signal, a start point of the porch period may be selected within a front porch period of the vertical synchronization signal, and an end point of the porch period may be selected within a back porch period of the vertical synchronization signal.

The buffer controller may be configured to control the bias current to be decreased by using different values for the period of up to the next horizontal synchronization signal and for the porch period of the vertical synchronization signal.

The output buffer may include source amplifiers for driving the flat panel display, and a number of source amplifiers in the output buffer may be determined based on a number of pixels included in one line of the flat panel display.

The source change enable signal may be a signal for changing a signal received by the output buffer.

The display enable signal may be a signal for determining whether the panel is to be displayed based on the vertical synchronization signal.

In another general aspect, a driving device of a panel having a 2 to 1 multiplexer structure is configured to receive an image signal and a clock signal, and includes a driving circuit configured to convert the image signal into pixel data and output the pixel data, a timing controller configured to generate and output a vertical synchronization signal, a horizontal synchronization signal, a source change enable signal, and a display enable signal using the image signal and the clock signal, an output buffer including an input terminal configured to receive the pixel data and an output terminal connected to the panel, and a buffer controller connected to the timing controller and the output buffer and configured to control a bias current, applied to the output buffer, to be decreased by a value during a period.

The period may include a period from a point at which a second switch control signal of the panel rises, based on a current horizontal synchronization signal, up to a point at which a next horizontal synchronization signal occurs.

The period may include a porch period of the vertical synchronization signal.

The buffer controller may be configured to perform controlling during a period set considering a time taken for the bias current to change, a start point of the set period may be selected within a front porch period of the vertical synchronization signal, and an end point of the set period may be selected within a back porch period of the vertical synchronization signal.

The period may include a period from a point at which a second switch control signal of the panel rises, based on a current horizontal synchronization signal, up to a next horizontal synchronization signal, and a porch period of the vertical synchronization signal, wherein during the period of up to the next horizontal synchronization signal, the buffer controller may be configured to control a decreased bias current to return to an original value, by a margin earlier in time than the next horizontal synchronization signal, and wherein during the porch period of the vertical synchronization signal, a start point of the porch period may be selected within a front porch period of the vertical synchronization signal, and an end point of the porch period may be selected within a back porch period of the vertical synchronization signal.

The buffer controller may be configured to control the bias current to be decreased by using different values for the period of up to the next horizontal synchronization signal and for the porch period of the vertical synchronization signal.

In yet another general aspect, a driving method of a flat panel display, performed by a driving device that includes a driving circuit, a timing controller, an output buffer, and a buffer controller, includes receiving, by the driving device, an image signal and a clock signal, outputting, by the timing controller, a vertical synchronization signal, a horizontal synchronization signal, a display enable signal, and a source change enable signal using the image signal and the clock signal, outputting, by the driving circuit, pixel data of the image signal into the output buffer, and controlling, by the buffer controller, a bias current applied to the output buffer to be decreased by a value, during a porch period of the vertical synchronization signal and a period for the horizontal synchronization signal.

The period for the horizontal synchronization signal may be a period from a point where a charging of a pixel capacitor of the panel is completed based on a current horizontal synchronization signal to a next horizontal synchronization signal, and the control of the bias current may include controlling the bias current to be decreased by a value and then controlling the bias current to return to an original value, by a margin earlier in time than the next horizontal synchronization signal.

During the porch period of the vertical synchronization signal, a start point of the porch period may be selected within a front porch period of the vertical synchronization signal, and an end point of the porch period may be selected within a back porch period of the vertical synchronization signal.

The buffer controller may be configured to control the bias current to be decreased using different values for the porch period of the vertical synchronization signal and for the period for the horizontal synchronization signal.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
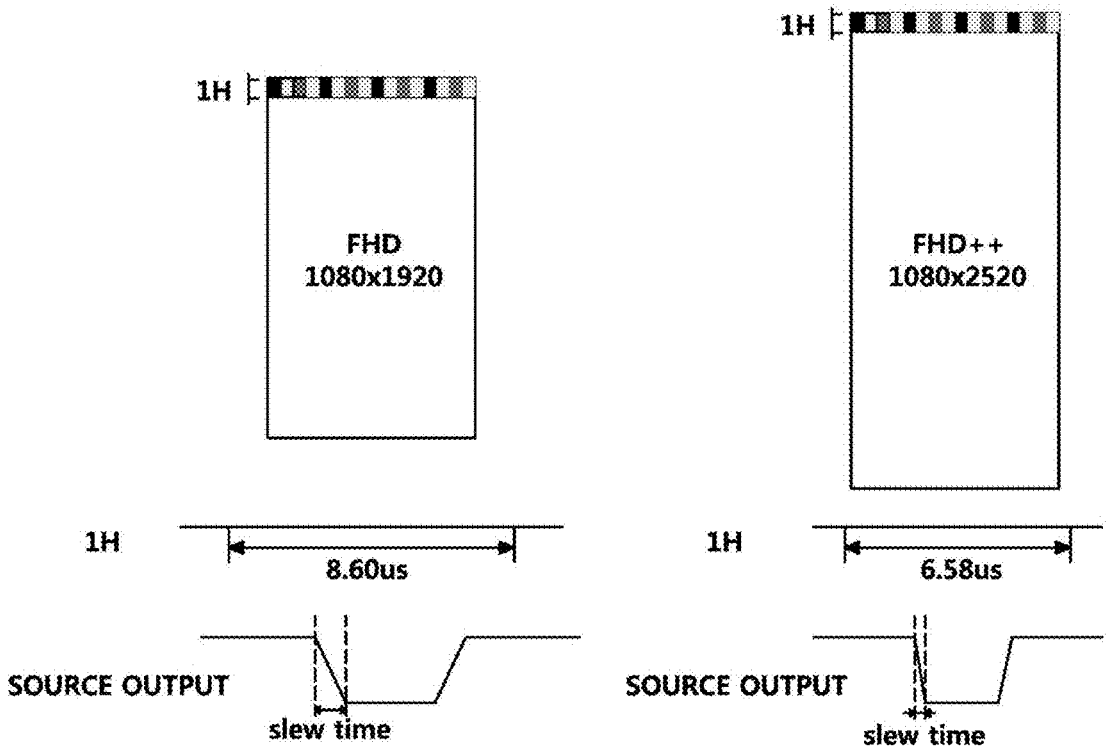
FIG. 1 is a diagram illustrating a relationship between a screen resolution and a slew time.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Herein, it is noted that use of the term "may" with respect to an example or embodiment, e.g., as to what an example or embodiment may include or implement, means that at least one example or embodiment exists where such a feature is included or implemented while all examples and embodiments are not limited thereto.

The following description is presented to provide a driving device of a flat panel display and a driving method of such a flat panel display capable of minimizing power consumption.

FIG. 1 is a diagram illustrating a relationship between a screen resolution and a slew time.

Referring to the example of FIG. 1, as the resolution of a panel increases to Full High-Definition++ (FHD++), with a resolution of 1080 by 2520 pixels, then a length of one horizontal period decreases accordingly from 8.60 usec to 6.58 usec. A reduction of a slew time in a source output (SOURCE OUTPUT) also occurs in accordance with the reduction of one horizontal period. That is, the above change occurs in order to output more pixels on a screen during the same time, because a refresh rate is kept constant, in spite of an increase in the screen resolution.

The refresh rate refers to a number of frames drawn per second. One horizontal period refers to a time taken for outputting a single row on a screen and is indicated by "1H." The slew time is also referred to as a slewing time and refers to a time taken for the SOURCE OUTPUT to change from one point, for example, low to another point, for example, high.

Figure 2:
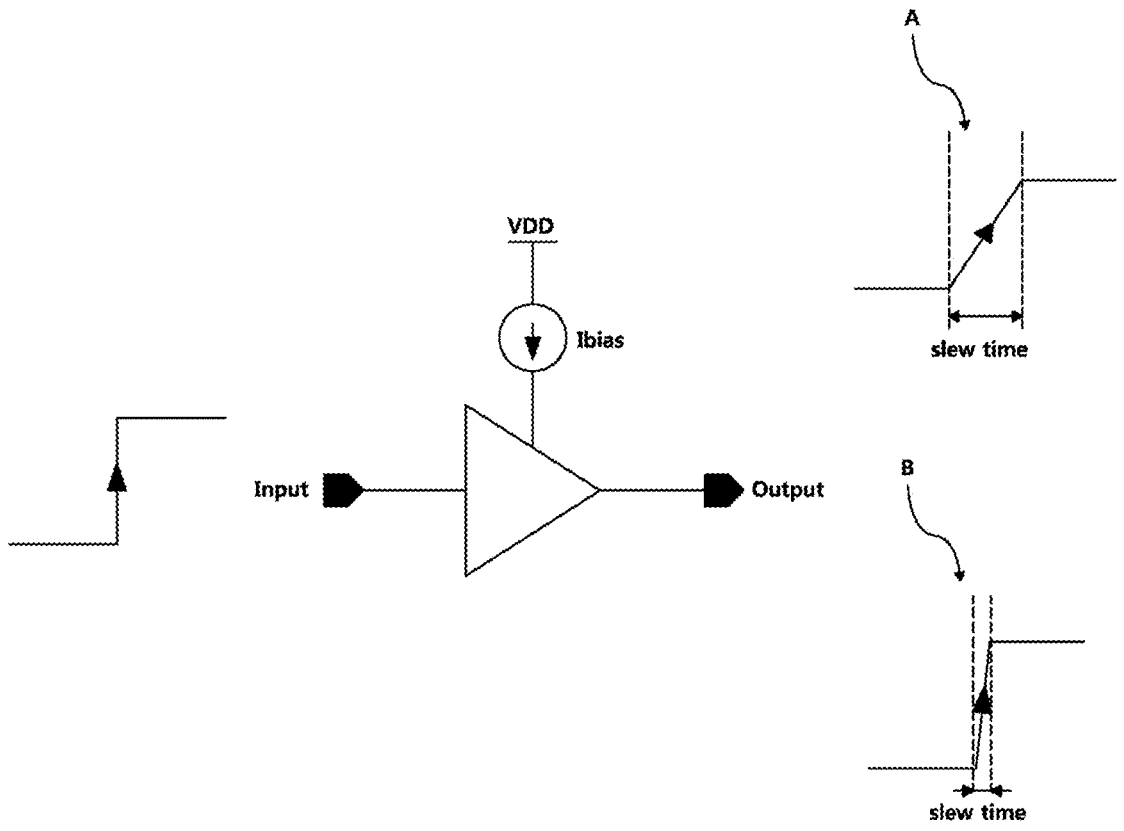
FIG. 2 is a diagram illustrating a relationship between a slew time and a bias current of a source amplifier.

FIG. 2 is a diagram for illustrating a relationship between a slew time and a bias current of a source amplifier.

In the example of FIG. 2, example A is an example in which a bias current (Ibias) entering a source amplifier is small in magnitude, and example B is an example in which the bias current is large in magnitude. Example A is an example in which a slew time is a relatively long time, whereas case B is an example in which the slew time is a relatively short time.

$$\text{Slewing Time} \propto \frac{1}{Ibias} \qquad \text{(Equation 1)}$$

As shown in Equation 1, a length of the slew time is inversely proportional to the size of the bias current of the source amplifier. In order to reduce the slew time, therefore, the bias current is to be increased. However, because an increase of the bias current of the source amplifier causes an increase of the overall current consumption of a driving device, the bias current of a source amplifier accordingly becomes the dominant factor for determining the power consumption of the driving device.

Figure 3:
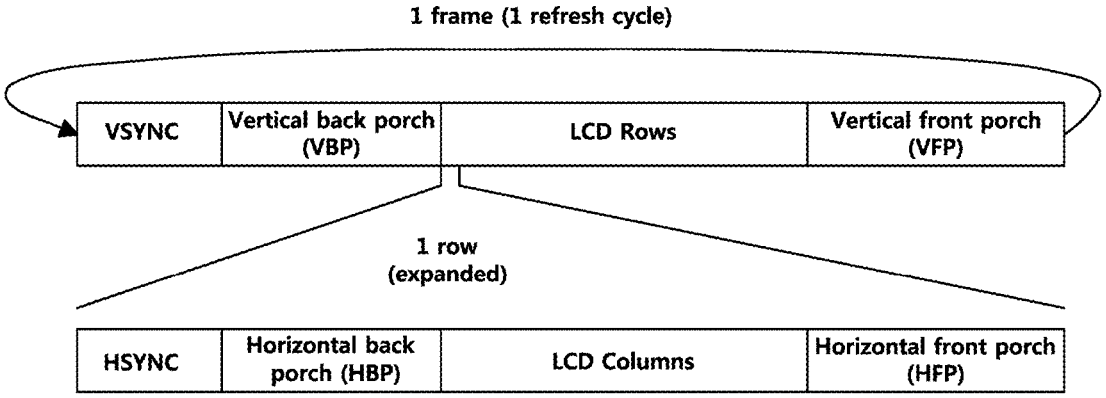
FIG. 3 is a diagram illustrating respective synchronization signals and porch periods according to the synchronization signals in a screen display.

FIG. 3 is a diagram for illustrating a relationship between respective synchronization signals and porch periods according to the synchronization signal in a screen display.

Referring to the example of FIG. 3, one frame includes a vertical synchronization signal (VSYNC), a vertical back porch (VBP), a plurality of rows (LCD Rows), and a vertical front porch (VFP). The vertical back porch (VBP) is positioned to be after the vertical synchronization signal (VSYNC), and the vertical front porch (VFP) is positioned to be before a next vertical synchronization signal (VSYNC). The term "line" refers to one row including a plurality of pixels on a screen, and thus, in the case of FHD++ (1080*2520), there are 2520 lines, each including 1080 pixels.

The vertical synchronization signal (VSYNC) is a signal indicating the start of a single frame of the screen. Furthermore, there are pluralities of horizontal synchronization signals (HSYNC) occurring between the vertical synchronization signals VSYNC. Each horizontal synchronization signal HSYNC is a signal indicating the start of one line in the frame.

Thus, one line or one row includes a horizontal synchronization signal HSYNC, a horizontal back porch (HBP), a plurality of columns (LCD Columns), and a horizontal front porch (HFP). For example, the HBP and the HFP are interval periods used to help synchronize the video information.

The plurality of columns LCD Columns each refer to a plurality of pixels, and in the case of FHD++ (1080*2520), there are 1080 pixels in one line.

Similar to the example of a vertical synchronization signal VSYNC, with respect to the horizontal back porch HBP and the horizontal front porch HFP, the horizontal back porch HBP is positioned after a horizontal synchronization signal HSYNC, and the horizontal front porch is positioned before the horizontal synchronization signal HSYNC. As discussed, the HBP and HFP provide time intervals that help successfully synchronize the video.

Likewise, the vertical back porch (VBP) and the vertical front porch (VFP) refer to preparation time required for front and back signals corresponding to Columns/Rows of an LCD display according to the specification of a panel, when image signals of the same frame are transmitted. Therefore, with respect to each synchronization signal, respective porches are non-display areas of the signals. Accordingly, making adjustments of bias current values of a source amplifier in the porch period does not affect the quality of image because no actual displaying occurs during the porch periods. The lengths of porch periods vary depending on the particular specification of a panel 10.

Figure 4:
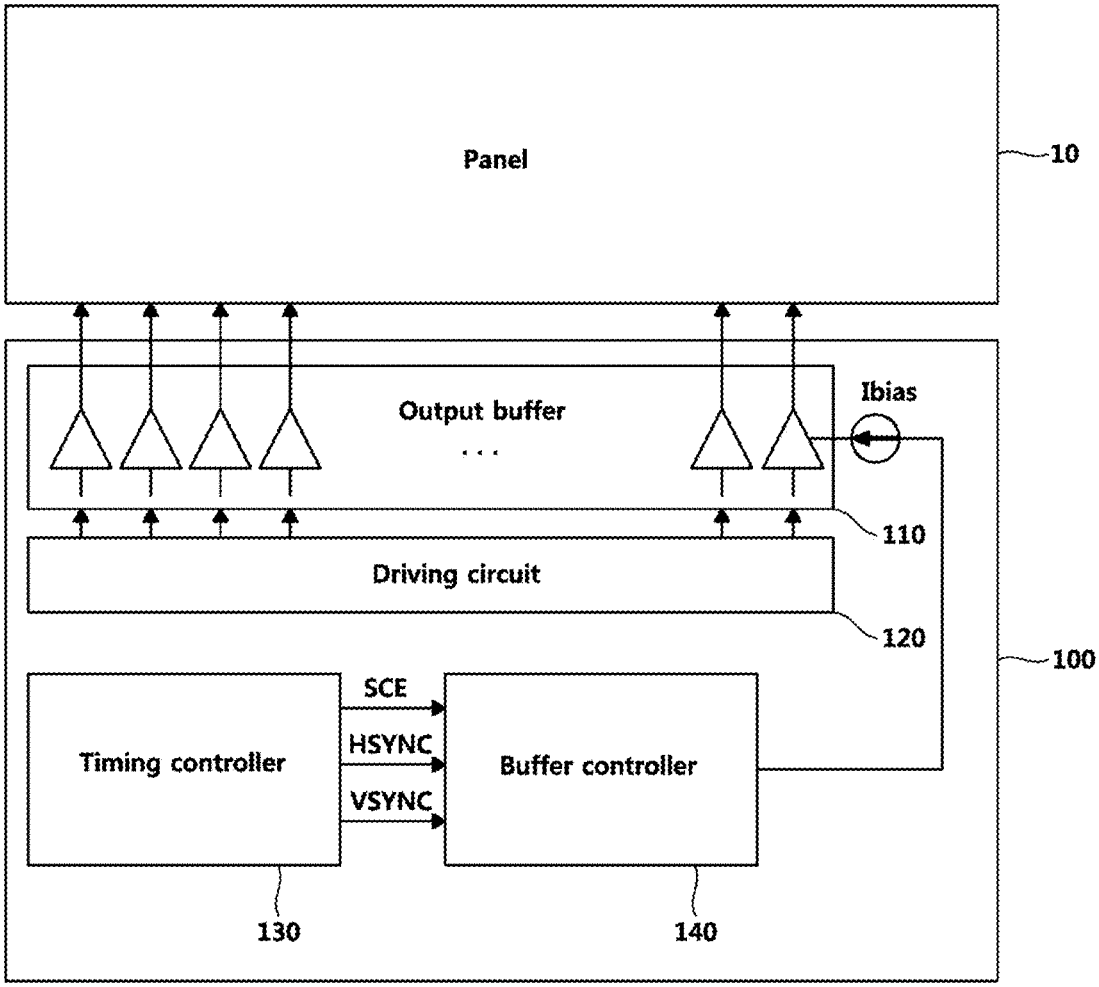
FIG. 4 is a diagram of an example of a driving device of a flat panel display.

FIG. 4 is a diagram of an example of a driving device of a flat panel display.

Referring to the example of FIG. 4, an example of a driving device 100 of a flat panel device receives image signals and clock signals related to images to be output to a panel. The driving device 100 includes an output buffer 110, a driving circuit 120, a timing controller 130, and a buffer controller 140. However, the driving device 100 is not limited to these elements, and other elements may be present.

The output buffer 110 includes a plurality of source amplifiers for driving the panel 10. A number of source amplifiers included in the output buffer 110 is determined by a number of pixels included in one line. For example, if there are 1080 pixels included in one line, there are a corresponding number of source amplifiers included in the output buffer 110.

Each of the plurality of source amplifiers is kept in an enabled state or in a turned-on state, and thus it is possible to easily provide a sufficient driving force to quickly charge/discharge the panel 10. The output buffer 110 allows the panel 10 to display images by charging or discharging a pixel load of the panel 10, according to pixel data received from the driving circuit 120.

In the example of FIG. 4, the panel 10 refers to a flat panel display. For example, the panel 10 includes all the panels according to various types of the flat panel display, such as LCD, OLED, and so on.

Also in the example of FIG. 4, the driving circuit 120 outputs pixel data of an image signal to the output buffer 110. In further detail, the driving circuit 120 converts a digital image signal into analog pixel data, and then transmits the analog pixel data to the output buffer 110, according to a signal received from the timing controller 130.

According to the example of FIG. 4, the timing controller 130 generates a vertical synchronization signal (VSYNC), a horizontal synchronization signal (HSYNC), a source change enable signal (SCE), and a display enable signal using the image signal and the clock signal. The timing controller 130 then outputs those signals to the driving circuit 120 and the buffer controller 140, appropriately.

A source change enable signal is a signal for changing a signal received by the output buffer 110 based on the horizontal synchronization signal HSYNC. Also, a display enable signal is a signal for determining whether the panel 10 is to be displayed based on the vertical synchronization signal VSYNC.

The vertical synchronization signal VSYNC indicates that the transmission of an image signal of a previous frame to the driving circuit 120 is completed, and the driving circuit 120 then prepares to transmit pixel data of a next frame, accordingly.

Effective data of the image signal is not included in each synchronization signal, and the corresponding porch periods. Therefore, in this example, the driving circuit 120 does not provide effective pixel data required to output to the panel 10 during a corresponding period.

A plurality of source amplifiers included in the output buffer 110 are kept in an enable state, that is, on in a turn-on state, so that the panel 10 is able to be quickly charged or discharged. However, because it is unnecessary to update the pixel data during the period during which the driving circuit 120 does not provide effective pixel data, it is a waste of energy to keep power provided in an on-state in such a period in order for the output buffer 110 to drive the panel 10.

As described above, in the example of FIG. 4, the buffer controller 140 controls bias current Ibias of the output buffer 110 by using a signal inputted for a period during which energy is wasted by the output buffer 110.

For example, the buffer controller 140 may use a counter to determine control periods of the bias current and calculate the control periods, accordingly, by using a signal inputted from the timing controller 130.

Specifically, the buffer controller 140 controls the bias current applied to the output buffer 110 in order to decrease the bias current by a predetermined value, during a period from a point at which charging of a pixel capacitor of the panel 10 is completed, based on a current horizontal synchronization signal HSYNC, to a next horizontal synchronization signal HSYNC.

For example, in a panel 10 having a structure of 2 to 1 Multiplexers, that is, a 2:1 MUX, the buffer controller 140 reduces the bias current applied to the output buffer 110 by a predetermined value for a period lasting from a point in time at which a second switch control signal (CLB) rises to the time of a next horizontal synchronization signal (HSYNC).

One reason why the buffer controller 140 reduces the bias current by a predetermined value, rather than the change to zero (0), is to minimize the influence of the change of the bias current on the image quality. It takes time to return the bias current to an original value after the bias current decreases. If the bias current is reduced to 0 without considering the need for sufficient return time, a next line may not be output normally.

The specific degree of decreasing the bias current, as discussed above, may be appropriately set or changed in consideration of the specification and resolution of the particular panel 10.

According to another example, in a panel 10 having a structure of a different type of multiplexer, the buffer controller 140 may control the bias current so as to be reduced by a predetermined value for a period lasting from a point in time at which a last switch control signal rises to high in the occurrence of a horizontal synchronization signal HSYNC, to a next horizontal synchronization signal HSYNC.

That is, even in consideration of the panel 10 having a different multiplexer, a switch inside the panel 10 is turned off during a period starting from a point in time at which a last switch control signal becomes high, which is the same time as which a source amplifier is floated. Therefore, the buffer controller 140 may control the bias current Ibias from such a point indicated as the point in time at which a last switch control signal becomes high to a next horizontal synchronization signal HSYNC.

The period may become a shorter period depending on characteristics of a panel 10 to be driven. That is, the panel may have physical aspects affecting what is necessary for putting a margin in consideration of a time taken for a bias current of a source amplifier to change. Such a margin may allow the influence on image quality to be minimized by the bias current Ibias, while still minimizing power requirements.

With respect to applying the margin, a start point and an end point of a control period of the bias current may be individually changed in consideration of factors of the panel, such as specification, the resolution, and so on.

In the example of FIG. 4, the buffer controller 140 controls the bias current Ibias so as to be decreased by a predetermined value not only for the horizontal synchronization signal HSYNC, but also for a relevant porch period of the vertical synchronization signal VSYNC. In this example, the buffer controller 140 may control the bias current Ibias to have different values for the horizontal synchronization signal and the vertical synchronization signal.

As described above, a driving device 100 of a flat panel display according to the present examples may reduce power consumption, without affecting the image quality, by controlling a driving circuit 120 in order to reduce a bias current during a period in which the effective pixel data is not provided.

According to an example, a driving method of a flat panel display by a driving device 100 of the flat panel display may be performed.

For example, the driving device 100 of a flat panel display according to the example may receive an image signal and a clock signal. At this time, at which these signals are received, a timing controller 130 may output, accordingly, a vertical synchronization signal, a horizontal synchronization signal, a display enable signal, and a source change enable signal, based on the image signal and the clock signal.

At this point in time, the driving device 100 of the flat panel display, according to an example, controls the bias current so as to be decreased by a predetermined value after a time point where charging of a pixel capacitor of the panel 10 based on a current horizontal synchronization signal HSYNC occurs. The driving device 100 then controls the bias current so as to return to an original value, based on a predetermined margin earlier in time than a next horizontal synchronization signal HSYNC. Using such a margin when controlling the bias current allows power to be conserved without adversely affecting display performance.

A driving device 100 of a flat panel display, according to another example, reduces a bias current by a predetermined value with respect to a porch period of the vertical synchronization signal and then returns to an original value one horizontal period earlier than a change time point of the display enable signal.

According to an example of a driving device 100 of a flat panel display, the driving circuit 120 may output pixel data of the image signal to the output buffer 110, and the buffer controller 140 may reduce a bias current applied to the output buffer 110 for a porch period of the vertical synchronization signal and a predetermined period of the horizontal synchronization signal by a predetermined value. Such a predetermined period is a period from a point in time at which charging of a pixel capacitor of a panel 10 is complete, based on a current horizontal synchronization signal HSYNC, to a next horizontal synchronization signal HSYNC.

Figure 5:
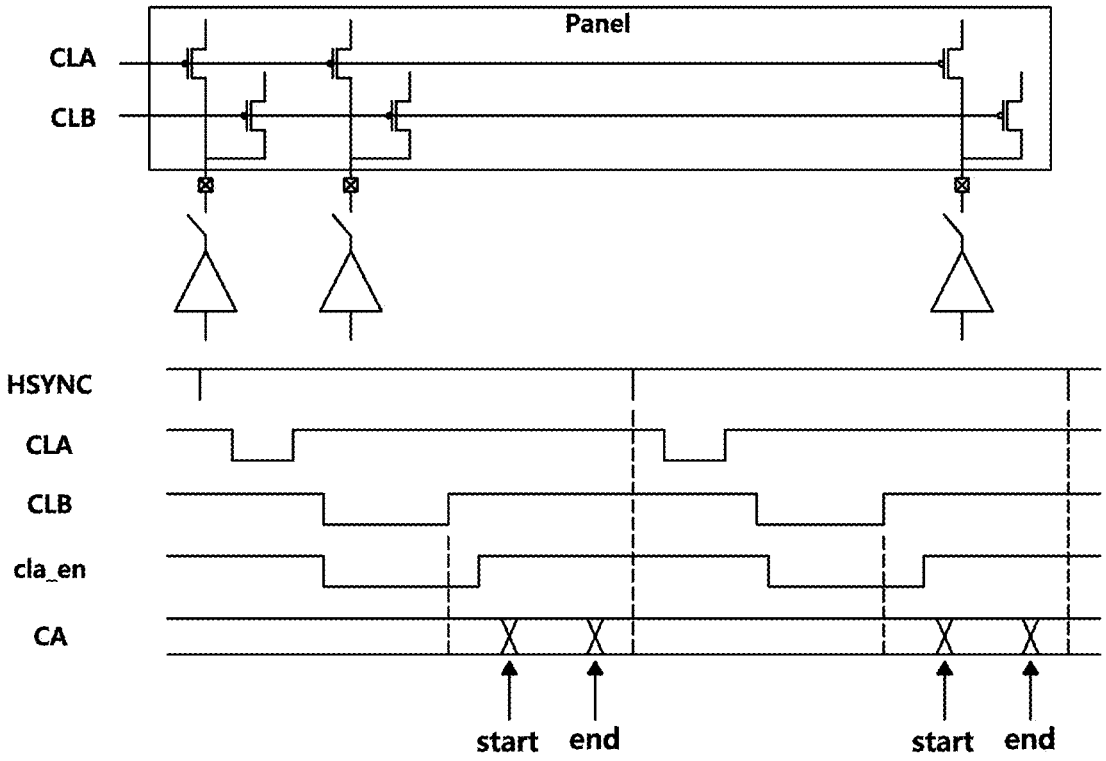
FIG. 5 is a diagram illustrating a control period of a bias current based on a horizontal synchronization signal, according to an example.

FIG. 5 is a diagram for explaining a bias current controlling period based on a horizontal synchronization signal according to an example.

Referring to the example of FIG. 5, a panel 10 has a structure of a 2 to 1 multiplexer. As for switch control signals, there are a first switch control signal (CLA) and a second switch control signal (CLB). A source change enable signal (cla_en) is a signal used for changing data inputted into an output buffer 110.

When both of the first switch control signal CLA and the second switch control signal CLB are set to be high, the switches inside the panel 10 are turned off, which is the same situation as an example in which a source amplifier floats. Therefore, the control of the bias current Ibias does not affect an image quality of the panel 10.

Additionally, the buffer controller 140 reduces a bias current Ibias applied to an output buffer 110 by a predetermined value in connection with a period from a point in time at which a second switch control signal CLB rises to the occurrence of a next horizontal synchronization signal HSYNC.

The above-mentioned period refers to a period during which current can be controlled at a maximum value, and a start point and an end point of the control period may be individually set when applying a margin in consideration of a time period taken for a bias current of a source amplifier to change.

In the example of FIG. 5, CA indicates whether a bias current of a source amplifier is controlled. As illustrated in the example of FIG. 5, the buffer controller 140 may reduce the bias current Ibias by a predetermined value in connection with a period from a start point to an end point, configured in consideration of the time taken for a bias current of a source amplifier to change.

Figure 6:
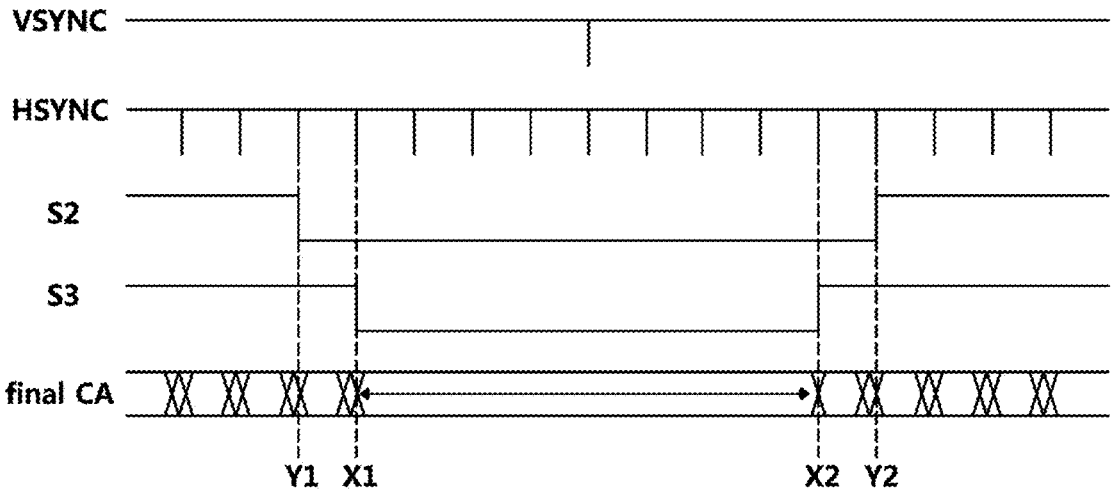
FIG. 6 is a diagram illustrating controlling of a bias current using a horizontal synchronization signal, a vertical synchronization signal, and display enable signals, according to another example.

FIG. 6 is a diagram illustrating controlling of a bias current using a horizontal synchronization signal, a vertical synchronization signal, and display enable signals according to another example.

According to other examples, power consumption is minimized by controlling the bias current of the output buffer 110 to be decreased by a predetermined value for specific periods corresponding to a horizontal synchronization signal HSYNC and a vertical synchronization signal VSYNC.

Referring to the example of FIG. 6, at each specific period of each horizontal synchronization signal HSYNC, the bias current of the output buffer 110 is controlled to be decreased by the predetermined value, and the same controlling is performed for a specific period of a vertical synchronization signal VSYNC. Furthermore, the bias current of the output buffer 110 is controlled using different values for each control period of a horizontal synchronization signal HSYNC and a vertical synchronization signal VSYNC.

Accordingly, the buffer controller 140 controls the bias current using different values. For example, the buffer controller 140 controls the bias current to be decreased to a value of 4 for a specific period of a horizontal synchronization signal HSYNC, and controls the bias current to be decreased to a value of 1 for a specific period of a vertical synchronization signal VSYNC.

In the example of FIG. 6, a specific period of the horizontal synchronization signal HSYNC is the same as described in the examples of FIGS. 4 to 5.

Accordingly, the buffer controller 140 generates a signal S3 corresponding to a display enable signal S2 for current control. Such a signal S3 is used as a current control enable signal.

A period during which the signal S3 becomes low is the same period as a specific period of the horizontal synchronization signal HSYNC. In detail, a specific period of the vertical synchronization signal VSYNC includes a period from a point X1 to a point X2, wherein the point X1 is a point one line later a point Y1 where a display enable signal S2 becomes low and the point X2 is one line earlier than a point Y2 where the display enable signal S2 becomes high.

The example of FIG. 6 is illustrated on the basis of one line, and a start point X1 and an end point X2 of control period may be individually set considering a time when a bias current controlled to have a decreased value is changed.

In further detail, the point X1 may be selected within a front porch period (VFP) of the vertical synchronization signal VSYNC, for example, 16 horizontal periods, and the end point X2 may be selected within a back porch period (VBP), for example, 16 horizontal periods. In examples, the duration of a porch period of the vertical synchronization signal VSYNC may differ depending on characteristics of a panel 10, and a start point and an end point of a control period may be changed accordingly.

As described above, in examples, the buffer controller 140 may normally output a next frame without affecting image quality, according to the control of a bias current of a source amplifier, by performing the control in consideration of a time taken for the bias current to change.

In addition, in the example of FIG. 6, a bias current, that is, a final CA of the output buffer 110 controlled by the buffer controller 140 is controlled based on horizontal synchronization signal HSYNC and vertical synchronization signal VSYNC to have different values, thereby reducing power consumption as well as minimizing influence on image quality.

The above description provides an example of a driving device of a flat panel display and a driving method of such a driving device that may reduce a bias current during a period in which effective pixel data is not provided to the flat panel display, thereby reducing power consumption without influencing image quality.

In addition, examples of a driving device of a flat panel display and a driving method of such a flat panel display may minimize power consumption of the flat panel display and add a margin in consideration of a time taken for controlling a bias current of a source amplifier, thereby minimizing influence on image quality of the actions taken to reduce power consumption.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A driving device of a flat panel display configured to receive an image signal and a clock signal, the device comprising:

a driving circuit configured to convert the image signal into pixel data and output the pixel data;

a timing controller configured to generate and output a vertical synchronization signal, a horizontal synchronization signal, a source change enable signal, and a display enable signal using the image signal and the clock signal;

an output buffer comprising an input terminal configured to receive the pixel data and an output terminal connected to the flat panel display; and a buffer controller connected to the timing controller and the output buffer and configured to control a bias current, applied to the output buffer, to be decreased by a preset value during a predetermined period, wherein the predetermined period comprises a period from a point at which a charging of a pixel capacitor of the flat panel display is completed based on a current horizontal synchronization signal, up to a next horizontal synchronization signal, wherein during the period of up to the next horizontal synchronization signal, the buffer controller is configured to control a decreased bias current to return to an original value, by a margin earlier in time than the next horizontal synchronization signal, and wherein the buffer controller is configured to reduce the bias current by the preset value such that the decreased bias current is larger than zero.

2. The device of claim 1, wherein the predetermined period further comprises a porch period of the vertical synchronization signal.

3. The device of claim 2, wherein the buffer controller is configured to perform controlling during a period set considering a time taken for the bias current to change, a start point of the set period is selected within a front porch period of the vertical synchronization signal, and an end point of the set period is selected within a back porch period of the vertical synchronization signal.

4. The device of claim 2, wherein during the porch period of the vertical synchronization signal, a start point of the porch period is selected within a front porch period of the vertical synchronization signal, and an end point of the porch period is selected within a back porch period of the vertical synchronization signal.

5. The device of claim 4, wherein the buffer controller is configured to control the bias current to be decreased by using different values for the period of up to the next horizontal synchronization signal and for the porch period of the vertical synchronization signal.

6. The device of claim 1, wherein the output buffer comprises source amplifiers for driving the flat panel display, and a number of source amplifiers in the output buffer is determined based on a number of pixels included in one line of the flat panel display.

7. The device of claim 1, wherein the source change enable signal is a signal for changing a signal received by the output buffer.

8. The device of claim 1, wherein the display enable signal is a signal for determining whether the panel is to be displayed based on the vertical synchronization signal.

9. A driving device of a panel having a 2 to 1 multiplexer structure configured to receive an image signal and a clock signal, the device comprising:

a driving circuit configured to convert the image signal into pixel data and output the pixel data;

a timing controller configured to generate and output a vertical synchronization signal, a horizontal synchronization signal, a source change enable signal, and a display enable signal using the image signal and the clock signal;

an output buffer comprising an input terminal configured to receive the pixel data and an output terminal connected to the panel; and a buffer controller connected to the timing controller and the output buffer and configured to control a bias current, applied to the output buffer, to be decreased by a preset value during a predetermined period, wherein the predetermined period comprises a period from a point at which a second switch control signal of the panel rises based on a current horizontal synchronization signal, up to a next horizontal synchronization signal, wherein during the period of up to the next horizontal synchronization signal, the buffer controller is configured to control a decreased bias current to return to an original value, by a margin earlier in time than the next horizontal synchronization signal, and wherein the buffer controller is configured to reduce the bias current by the preset value such that the decreased bias current is larger than zero.

10. The device of claim 9, wherein the predetermined period further comprises a porch period of the vertical synchronization signal.

11. The device of claim 10, wherein the buffer controller is configured to perform controlling during a period set considering a time taken for the bias current to change, a start point of the set period is selected within a front porch period of the vertical synchronization signal, and an end point of the set period is selected within a back porch period of the vertical synchronization signal.

12. The device of claim 10, wherein during the porch period of the vertical synchronization signal, a start point of the porch period is selected within a front porch period of the vertical synchronization signal, and an end point of the porch period is selected within a back porch period of the vertical synchronization signal.

13. The device of claim 12, wherein the buffer controller is configured to control the bias current to be decreased by using different values for the period of up to the next horizontal synchronization signal and for the porch period of the vertical synchronization signal.

14. A driving method of a flat panel display, performed by a driving device that comprises a driving circuit, a timing controller, an output buffer, and a buffer controller, the method comprising:

receiving, by the driving device, an image signal and a clock signal;

outputting, by the timing controller, a vertical synchronization signal, a horizontal synchronization signal, a display enable signal, and a source change enable signal using the image signal and the clock signal;

outputting, by the driving circuit, pixel data of the image signal into the output buffer; and controlling, by the buffer controller, a bias current applied to the output buffer to be decreased by a preset value, during a predetermined period and a porch period of the vertical synchronization signal, wherein the predetermined period comprises a period from a point at which a charging of a pixel capacitor of the panel is completed based on a current horizontal synchronization signal up to a next horizontal synchronization signal, wherein during the period of up to the next horizontal synchronization signal, the buffer controller is configured to control a decreased bias current to return to an original value, by a margin earlier in time than the next horizontal synchronization signal, and wherein the buffer controller is configured to reduce the bias current by the preset value such that the decreased bias current is larger than zero.

15. The method of claim 14, wherein during the porch period of the vertical synchronization signal, a start point of the porch period is selected within a front porch period of the vertical synchronization signal, and an end point of the porch period is selected within a back porch period of the vertical synchronization signal.

16. The method of claim 15, wherein the buffer controller is configured to control the bias current to be decreased using different values for the porch period of the vertical synchronization signal and for the period for the horizontal synchronization signal.

* * * * *